United States Patent [19]

Glaesel

[11] 4,021,093

[45] May 3, 1977

[54] CONNECTION FRAME FOR ELECTRICAL INSTALLATIONS

[75] Inventor: Gottfried Glaesel, Ascona, Switzerland

[73] Assignee: Hego Electric G.m.b.H., Switzerland

[22] Filed: June 25, 1975

[21] Appl. No.: 590,172

[30] Foreign Application Priority Data

Feb. 28, 1975 United Kingdom ..... 8427/75

[52] U.S. Cl. ..... 339/198 H; 339/19

[51] Int. Cl.[2] ..... H01R 9/16

[58] Field of Search .... 339/198 R, 198 G, 198 GA, 339/198 H, 198 N, 210 M, 210 R, 19

[56] References Cited

UNITED STATES PATENTS

| | | | |
|---|---|---|---|
| 2,226,666 | 12/1940 | Lienzen | 339/198 H |
| 3,001,170 | 9/1961 | Eyre et al. | 339/198 GA |
| 3,486,160 | 12/1969 | Wallace, Jr. | 339/19 |
| 3,702,456 | 11/1972 | Patton | 339/198 H |
| 3,905,673 | 9/1975 | Evans et al. | 339/210 M |

FOREIGN PATENTS OR APPLICATIONS

| | | | |
|---|---|---|---|
| 1,134,588 | 12/1956 | France | 339/198 H |
| 984,252 | 2/1965 | United Kingdom | 339/198 H |

*Primary Examiner*—Roy Lake
*Assistant Examiner*—Neil Abrams
*Attorney, Agent, or Firm*—Pollock, Vande Sande & Priddy

[57] ABSTRACT

An electrical connection frame comprising two spaced parallel locating members each provided with a row of uniformly spaced locating apertures, and a plurality of plates of insulating material disposed face to face between and perpendicular to the locating members, at least some of the plates incorporating electrically conductive connection strips or pins, and at least some of the plates having projections engaging respective apertures, the thickness of the plates or an integral multiple thereof being slightly less than the aperture spacing or an integral multiple thereof whereby the overall thickness of the assembly of plates is determined solely by the aperture spacing.

5 Claims, 6 Drawing Figures

CONNECTION FRAME FOR ELECTRICAL INSTALLATIONS

This invention relates to a connection frame for electrical installations, consisting of a plurality of face-to-face plate-like marshalling units of insulating material with inserted contacts which project to form connection points for conductors to be connected, the contacts being held in the insulating material for example by locating notches or by having the insulating material molded around them.

Various types of connection frames for electrical installations, communication facilities and the like are already known, wherein the marshalling units are stacked one against another and are fixed, for example, by through bolts.

A disadvantage of this method of joining the individual units is the fact that in the manufacture of the units, e.g., by injection molding, size variations inevitably occur and, although these are small, when a large number of units is assembled in face to face contact, the variations become cumulated, and therefore automatic, e.g., electronically controlled machine wiring of the connection pins is impossible. This is clear if one considers that in arranging, for example, 50 frame units in a row, each with an assumed thickness tolerance of only $\pm 0.1$, the connecting pins of the fiftieth plate may be already 5 mm outside the chosen modular dimension. A wiring machine would not be able to correctly control programmed wiring of a plurality of pins in a plurality of units, especially with small module dimensions.

According to one aspect of the invention, we provide an electrical connection frame comprising two spaced parallel locating members each having a row of uniformly spaced locating apertures, and a plurality of plates of insulating material disposed face to face between and perpendicular to the locating members, at least some of the plates incorporating electrically conductive connection strips or pins, and at least some of the plates having projections engaging respective apertures, the thickness of the plates in relation to the aperture spacing being such that the overall thickness of the assembly of plates is determined solely by the aperture spacing. The thickness of the plates or an integral multiple thereof maybe slightly less than the aperture spacing or an integral multiple thereof.

According to a further aspect of the invention, we provide a connection frame for electrical installations, consisting of a plurality of face to face plate-like marshalling units of insulating material accommodating contacts which project from the frame units to form connection points for conductors to be connected, the contacts being held in the insulating material by locating notches, and wherein the spacing of the units with respect to each other and within a frame formation is determined by locating spigots which engage in holes in locating bars or other constructional components with hole spacings of small tolerance, the thickness of the units being smaller than the hole spacing.

In a connection frame embodying the invention, the tolerances which arise when the marshalling units are sequentially arranged no longer become assumed, and the predetermined module dimension is maintained, making mechanical wiring of the connection pins possible.

Preferably the insulating plates or marshalling units are disposed between two profiled bars of the well known kind used in plug-in housing construction. These bars are commercially available with a row of holes at an exact hole spacing of 5.08 mm., i.e., exactly twice the usual basic modular dimension of 2.54 mm. If the basic modular dimension of 2.54 mm. is used in making the marshalling units, then various assembly possibilities are obtained for the units in the bars, especially if the units are symmetrically constructed and are for example provided on only one side with locating spigots.

In an assembly of marshalling units, the contacts may be supported by two or more insulating plates. In particular, insulating plates may be provided only at the respective end regions of contacts where plug-in units span spaces in switch cabinets, the contacts extending unsupported across the space therebetween. The units may, if symmetrically constructed, also be stacked one on another between the bars.

The contacts may be straight, or may be U-shaped so that both spaced-apart ends project from a single side of the insulating plate.

Further characteristics, advantages and details of the present invention will be clear from the following description and the accompanying drawings in which.

Figure 1:
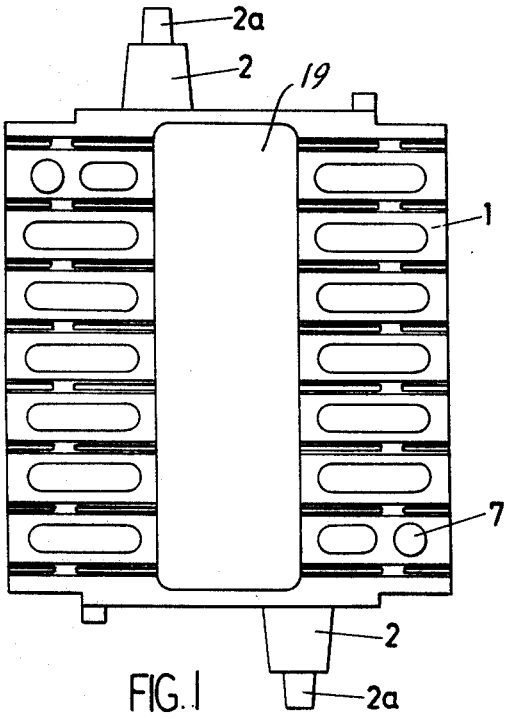
FIGS. 1 and 1A are front and side view of a marshalling unit.
Figure 1A:
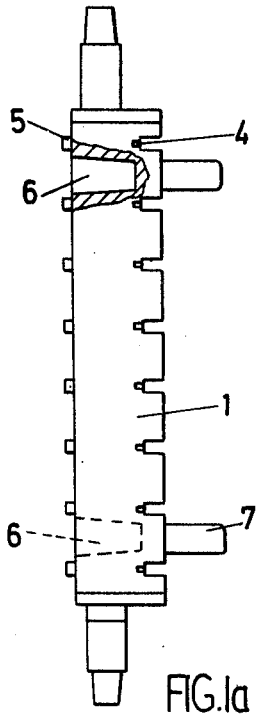

As shown in FIGS. 1 and 1*a*, the marshalling units 1 comprise insulating plates provided with support feet 2 on opposite narrow sides. On at least some units, at least one of the feet 2 carries a locating spigot 2*a*. One of the large faces of the unit contains grooves 4 for seating contact pins 9 (FIG. 2), the contacts 9 being fixed by locating lugs 5 of the next unit. Locating pins 7 and opposing locating holes 6 are provided in the units for locating them face to face.

Figure 2:
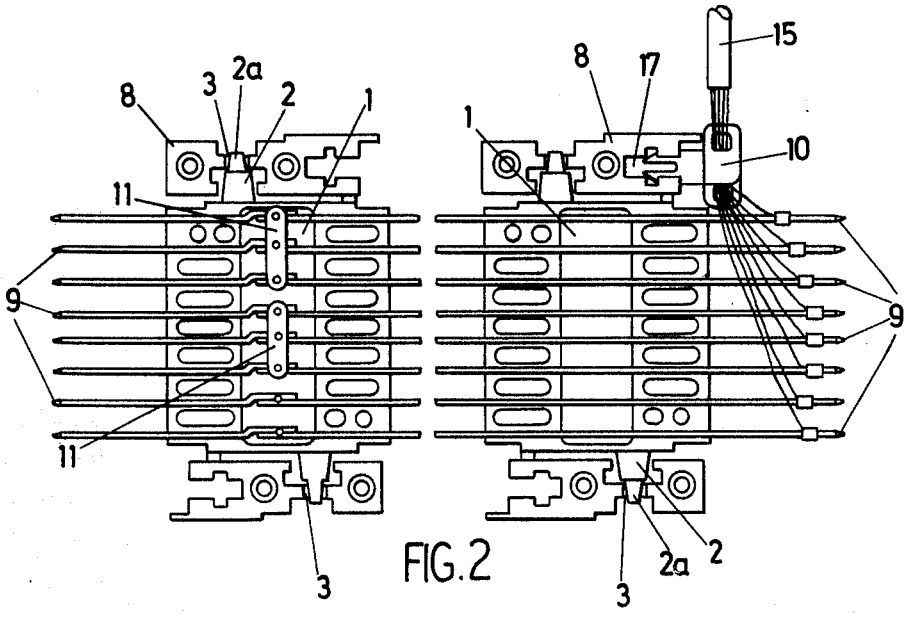
FIG. 2 shows an arrangement of marshalling units between locating bars, end brackets being omitted.

FIG. 2 shows an arrangement of the marshalling units, which are disposed with the help of the shaped support feet and spigots 2*a* between pairs of profiled bars 8 usual for example in plug-in housing construction, e.g., of the INTERMAS system. The spigots 2*a* engage in locating holes 3 in the bars 8. Contact pins 9 inserted in the units 1 span the space between the left and right units 1, extending freely across the interspace. In a central space 19 inside the units 1 it is possible to electrically join together individual contact pins 9 into groups by means of cross connections 11. The conductors 15 are led safely and in an ordered manner to the contact pins 9 by guide and support elements which guide the conductors and are plugged into a channel 17 in one of the bars 8.

Figure 3:
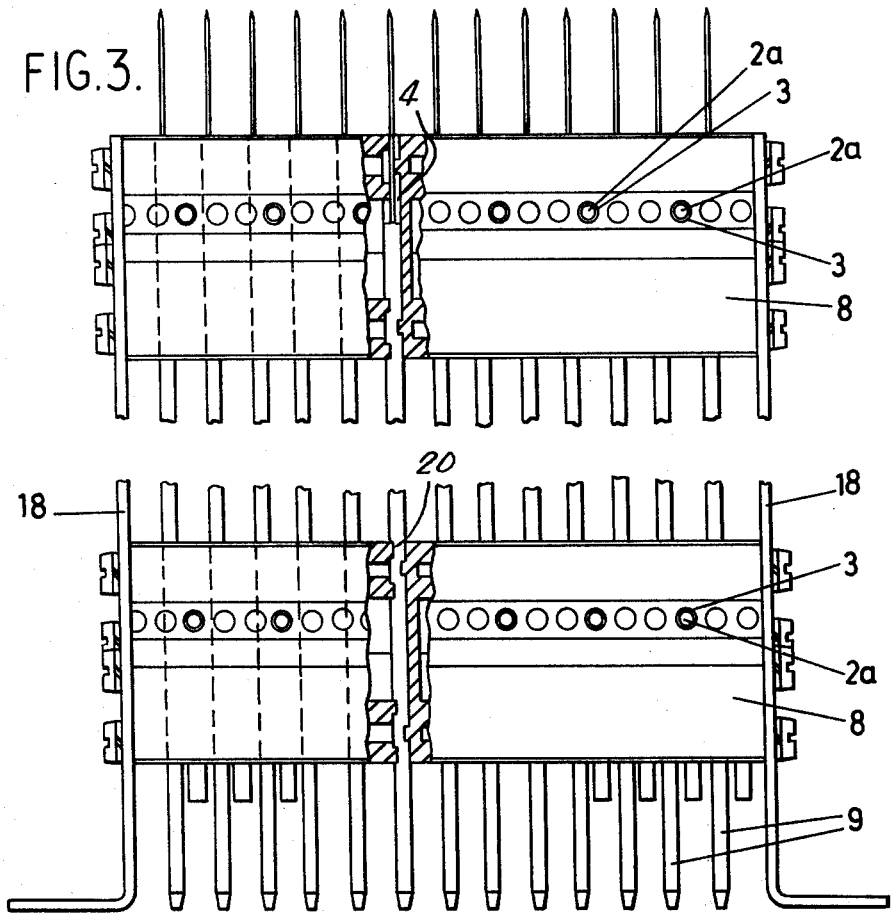
FIG. 3 is a side view of the arrangement of FIG. 2, showing end brackets.

FIG. 3 shows an arrangement similar to FIG. 2 and illustrates how the contact pins 9 are located in the units by means of notches 20.

Figure 4:
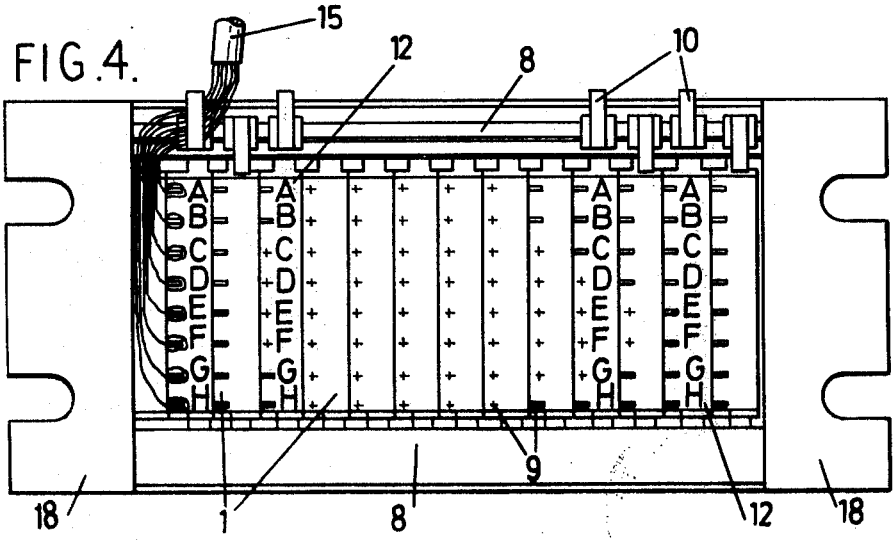
FIG. 4 shows another view of the arrangement of FIG. 3.

FIG. 4 shows an overall arrangement comprising units 1 inserted between bars 8 mounted between end fastening brackets 18. Cable guides 10 are fixed to the bars over the individual units 1. Markings 12 are provided on the front of the units. The manner in which the conductors 15 can be passed through the cable guides 10 is also shown. Alternatively guides may be provided on the marshalling units themselves.

Figure 5:
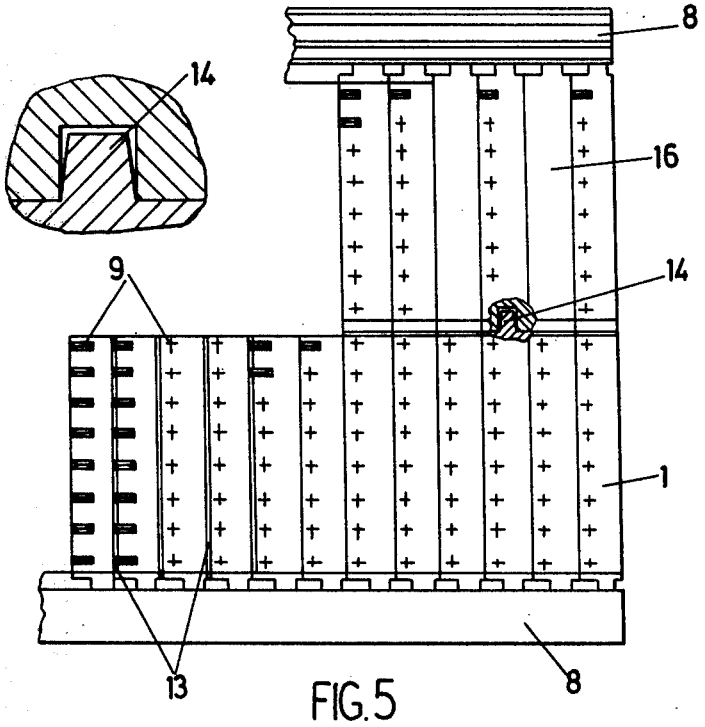
FIG. 5 shows marshalling units stacked side by side between two bars.

FIG. 5 shows an arrangement of overlying marshalling units 1 stacked between bars 8. The arrangement is possible because of the preferred symmetrical construction of the units 1. Moreover, it is evident here that by arranging, for example, contactless units or spacers 16 between two contact-carrying units 1, the assembly spacings, and thus the tracking path and air gap, can be increased. If screening is necessary, screening plates 13, for example, may also be disposed between the units 1. The units are located side by side by projections 14 and mating recesses; these projections 14 correspond to the feet 2 of FIGS. 1 to 4, spigots 2*a* (not shown) being provided on one side of each unit. On the assumption that the marshalling units 1 of insulating material are constructed in accordance with the already mentioned basic module dimension of 2.54 mm, there are various possible insertion arrangements using bars 8 with the standard hole spacing of 5.08 mm, i.e., double the basic module dimension of 2.54 mm. It may be necessary for the thickness of the units to exceed the hole spacing, for the purpose of observing the required minimum tracking path and air gap for a given reference voltage level. For example, according to VDE 0110 Gr. C, the smallest possible spacing of individual pins for a reference voltage of 250 V. a.c. is 3.5 mm. As, for example, the connection pins 9 used for wire wrap connections may be approximately 2.5 mm thick, a minimum thickness for the units 1 of 6 mm is required. Therefore in this case the next larger modular dimension to be chosen for the thickness of the units 1 is 7.62 mm (3 × 2.54 mm). The lowest common multiple of the hole spacing and frame unit thickness is therefore 15.24 mm. This means that only alternate spigots 2*a* of the units 1 can be inserted into a locating hole 3 of the bar 8, and, as can be seen in FIG. 3, in this case only every third, locating hole 3 of the bars 8 receives a spigot 2*a*. Preferably only one support foot 2 of each unit commprises a spigot 2*a*, the units 1 in other respects being symmetrically constructed, and alternate units are turned through 180°, so that the spigots 2*a* of these alternate units engage with locating holes 3 of the second bar 8, the holes in the latter being staggered relative to those of the first bar. Thus, odd-numbered units engage one bar and even-numbered units engage the other bar. Alternatively, the holes may be unstaggered, in which case some of the units (every other units in the case considered) would have no spigots 2*a*.

The manufacture of the marshalling units is controlled so that their average thickness is in fact slightly less than the nominal module of 2.54 mm (or an integral multiple thereof, e.g., 7.62 mm in the case considered above). Thus the units are not held in the tight face-to-face contact and the inevitable manufacturing tolerances are not cumulated, and the overall thickness of an asembly of units depends on the hole spacing, not on the thickness of individual units.

I claim:

1. An electrical modular connection assembly comprising two spaced parallel locating members each provided with a row of accurately uniformly spaced locating holes, and a plurality of modular plates of insulating material disposed face to face with one another between and perpendicular to the locating members, at least some of the plates having on at least one side a spigot engaging respective said holes, the thickness of the plates or an integral multiple thereof being less than the pitch of the holes or an integral multiple of the said pitch, at least some of the plates incorporating electrically conductive terminal strips, grooves in the plates containing and deeper than the terminal strips, matching lugs on the plates arranged to enter said terminal strip containing grooves of adjacent plates, and central spaces passing through the plates from face to face across which said strips extend, a plurality of the terminal strips extending across a single central space, each one of said strips being located in a groove on each side of such central space, the plates being provided on their faces with projections and matching recesses free of terminal strips for interengagement of adjacent plates.

2. An assembly as claimed in claim 1, wherein the said projections and recesses comprise pins on and holes in the faces of the frames.

3. An assembly as claimed in claim 1, including a cross-connection between at least two terminal strips in at least one said plate, such cross-connection being disposed in the central space of the associated plate.

4. An assembly as claimed in claim 1, including means for locating the conductors connected to the terminal strips.

5. An assembly as claimed in claim 1, wherein a said spigot is located on only one side of each plate.

* * * * *